US006846368B2

(12) United States Patent
Katsuragi et al.

(10) Patent No.: US 6,846,368 B2
(45) Date of Patent: Jan. 25, 2005

(54) CASTING STEEL HAVING HIGH STRENGTH AND LOW THERMAL EXPANSION

(75) Inventors: Susumu Katsuragi, Tochigi (JP); Toshiaki Nonomura, Shimane (JP); Yasuhiro Ojiro, Hyogo (JP); Daisuke Izutsu, Hyogo (JP)

(73) Assignees: Hitachi Metals, Ltd., Tokyo (JP); Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/485,812

(22) PCT Filed: Jul. 8, 2002

(86) PCT No.: PCT/JP02/06883

§ 371 (c)(1),
(2), (4) Date: Feb. 10, 2004

(87) PCT Pub. No.: WO2004/005565

PCT Pub. Date: Jan. 15, 2004

(65) Prior Publication Data

US 2004/0197220 A1 Oct. 7, 2004

(51) Int. Cl.[7] ..... C22C 30/00; C22C 38/00

(52) U.S. Cl. ..... 148/333; 148/336; 420/95; 420/97

(58) Field of Search ..... 148/333, 336; 420/95, 97

(56) References Cited

U.S. PATENT DOCUMENTS 6,142,731 A 11/2000 Dewis et al.

6,344,095 B1 2/2002 Kawabata et al.

FOREIGN PATENT DOCUMENTS

| | | |
|---|---|---|
| GB | 1410732 | * 10/1975 |
| JP | 57-041350 | 3/1982 |
| JP | 62-067201 | 3/1987 |
| JP | 63-060255 | 3/1988 |
| JP | 64-21037 | 1/1989 |
| JP | 07228947 | * 8/1995 |
| JP | 8-100242 | 4/1996 |
| JP | 2002-206143 | 7/2002 |

* cited by examiner

*Primary Examiner*—Sikyin Ip
(74) *Attorney, Agent, or Firm*—Oblon, Spivak, McClelland, Maier & Neustadt, P.C.

(57) ABSTRACT

The present invention provides a cast steel for ring-shaped components that has a low average coefficient of thermal expansion in a temperature range of 20° C. to 500° C. and high strength and good oxidation resistance at 500° C., which are required for ring-shaped components for use as blade rings and seal ring retainers of gas turbines, and that can hence be used for blade rings and seal ring retainers of gas turbines. Specifically, the present invention provides a high-strength and low-thermal expansion cast steel comprising, on a mass percentage basis, 0.1 to 0.8% of C, 0.1 to 1.0% of Si, 0.1 to 1.0% of Mn, 0.01 to 0.1% of S, greater than 40% and up to 50% of Ni, not greater than 4% (inclusive of 0%) of Co, greater than 1.5% and up to 4% of Cr, 0.01 to 0.1% of Al, and 0.001 to 0.1% of Mg, the remainder being substantially Fe.

6 Claims, No Drawings

CASTING STEEL HAVING HIGH STRENGTH AND LOW THERMAL EXPANSION

TECHNICAL FIELD

This invention relates to a high-Ni and low-thermal expansion cast steel having an excellent high-temperature strength and good oxidation resistance, and to ring-shaped components for use as blade rings and seal ring retainers of gas turbines which are formed of such a high-strength and low-thermal expansion cast steel.

BACKGROUND ART

As an application requiring high strength and low thermal expansion properties at high temperatures, there are known, for example, ring-shaped components for use as blade rings or seal ring retainers of gas turbines. Conventionally, in ring-shaped components for use as blade rings of gas turbines, and the like, high strength and low thermal expansion properties have been required even at high temperatures. Materials used in such applications have included SCPH21 (1.2Cr-0.5Mo cast steel), SCPH32 (2.2Cr-1.0Mo cast steel), SCS1 (13Cr cast steel) and the like.

In recent years, however, it is required to reduce clearances for absorbing differential thermal expansion between blades and blade rings and between seal fins and seal ring retainers, in order to enhance the efficiency of gas turbines. Consequently, a material exhibiting lower thermal expansion than conventional materials is needed for the formation of such ring-shaped components for use as blade rings and seal ring retainers of gas turbines. As low-thermal expansion alloys meeting this requirement for low-thermal expansion properties, Invar alloy (36% Ni—Fe), Super-invar alloy (31% Ni-5% Co—Fe) and the like are known, and a large number of Invar alloy castings utilizing Invar properties have been reported.

However, in most of the Invar alloy castings, importance is usually attached to an average coefficient of thermal expansion in a relatively low temperature region extending from ordinary temperature to about 200° C. In fact, these Invar alloy castings have excellent low-thermal expansion properties in a low temperature region of the order of 200° C. However, in such applications as ring-shaped components for use as blade rings or seal ring retainers of gas turbines which are heated to a high temperature of the order of 500° C. during service, such Invar alloy castings are unsuitable because the clearances between blades and blade rings and between seal fins and seal ring retainers change considerably as a result of a rapid increase in coefficient of thermal expansion. Moreover, owing to its low strength, Invar alloy cannot be used in applications requiring both a low coefficient of thermal expansion and high strength, such as ring-shaped components for use as blade rings and seal ring retainers of gas turbines.

In order to maintain low thermal expansion up to a high temperature region of the order of 500° C., it is necessary to shift the magnetic transformation point to a higher temperature. As a means to this end, an increase in Ni content and the addition or increase of Co is commonly known. Such high-Ni/Co Invar alloy castings have been proposed in Japanese Patent Laid-Open No. 41350/'82, Japanese Patent Laid-Open No. 21037/'89, and Japanese Patent Laid-Open No. 60255/'88. In the alloy casting described in the aforementioned Japanese Patent Laid-Open No. 41350/'82, the combined content of Ni and Co is in the range of 38 to 45%. As a result, it is described therein that its coefficient of thermal expansion in a temperature range extending from ordinary temperature to 300–500° C. is reduced and, moreover, its ordinary-temperature strength is very high. This alloy casting can surely exhibit low-thermal expansion properties in a low temperature region of the order of 300° C. However, in high-temperature applications such as ring-shaped components for use as blade rings or seal ring retainers of gas turbines, its oxidation resistance and high-temperature strength at about 500° C. are unsatisfactory because of a low Cr content up to 1.0%. Moreover, in this alloy casting, no consideration is given to Si that is important for the improvement of castability or to Mg and S that are necessary for the purpose of inoculation for graphite.

In the alloy described in Japanese Patent Laid-Open No. 21037/'89, the Ni content is as low as 28.0–32.0%, but a large amount of Co is added in the range of 8.0–18.0%. Thus, it is disclosed that its average coefficient of thermal expansion in a temperature range of 30° C. to 500° C. shows a low value of not greater than $7.5\times10^{-6}$/° C. However, this alloy does not contain any element that serves to improve high-temperature strength and oxidation resistance at 500° C., and is hence unable to achieve high strength at a high temperature of the order of 500° C.

The alloy described in Japanese Patent Laid-Open No. 60255/'88 contains 29–33% of Ni and 4.5–6.5% of Co. However, owing to a low Ni content, its average coefficient of thermal expansion up to a high temperature of the order of 500° C. is unsatisfactorily high. Moreover, 1.0 to 2.7% of C is added in order to improve machinability with importance attached to machining accuracy, so that a large amount of spheroidal graphite is precipitated. Not only the precipitation of a large amount of spheroidal graphite causes a reduction in strength on the other hand, but also the addition of a large amount of C increases the coefficient of thermal expansion up to a high temperature (500° C.).

DISCLOSURE OF THE INVENTION

An object of the present invention is to provide a cast steel that has both a low average coefficient of thermal expansion in a temperature range of 20° C. to 500° C. and high strength and good oxidation resistance at about 500° C., which are required for ring-shaped components for use as blade rings and seal ring retainers of gas turbines, and that is hence suitable for the formation of ring-shaped components for use as blade rings and seal ring retainers of gas turbines. In order to achieve a sufficient strength in a temperature range extending from ordinary temperature to about 500° C. and to keep down the coefficient of thermal expansion in a temperature range of 20° C. to 500° C., the present inventors made investigations on various alloying elements and their contents. As a result, it has been found that an increase in coefficient of thermal expansion can be prevented by incorporating appropriate amounts of Ni and Co, an excellent strength can be obtained even at temperatures of the order of 500° C. by incorporating appropriate amounts of C and Cr, and moreover, a reduction in high-temperature strength can be suppressed by adding appropriate amounts of such elements as S, Mg and Al. This finding has made it possible to combine high strength at 500° C. with a low coefficient of thermal expansion in a temperature range of 20° C. to 500° C., leading to the achievement of the present invention.

Thus, the present invention relates to a high-strength and low-thermal expansion cast steel comprising, on a mass percentage basis relative to the mass of the alloy, 0.1 to 0.8% of C, 0.1 to 1.0% of Si, 0.1 to 1.0% of Mn, 0.01 to 0.1% of S, greater than 40% and up to 50% of Ni, not greater than 4% (inclusive of 0%) of Co, greater than 1.5% and up to 4% of Cr, 0.01 to 0.1% of Al, and 0.001 to 0.1% of Mg, the remainder being substantially Fe. This high-strength and low-thermal expansion cast steel is preferably characterized in that its average coefficient of thermal expansion in a temperature range of 20° C. to 500° C. is not greater than $10.5\times10^{-6}$/° C.

Moreover, the aforesaid high-strength and low-thermal expansion cast steel is preferably characterized in that its 0.2% yield strength at 500° C. is not less than 120 MPa and, furthermore, its oxidation weight gain after heating at 500° C. for 100 hours is not greater than 10 g/m$^2$.

According to the present invention, the aforesaid high-strength and low-thermal expansion cast steel may be used for the formation of ring-shaped components for use as blade rings and seal ring retainers of gas turbines.

The present invention will be described hereinbelow in greater detail.

First of all, the most striking feature of the present invention is a chemical composition which exhibits excellent low-thermal expansion properties even in a high-temperature region up to 500° C. and, moreover, shows a low coefficient of thermal expansion and an excellent strength even at temperatures of the order of 500° C. Various elements specified in the present invention and their content ranges are described below. In the present invention, the contents of various elements are expressed as mass percentages based on the mass of the alloy, unless otherwise stated.

C: 0.1–0.8%

C has the effect of passing into solid solution in the matrix of an alloy and thereby increasing the strength of the alloy. If the content of C is less than 0.1%, its strength-increasing effect will be insufficient. If the content of C is greater than 0.8%, not only the coefficient of thermal expansion of the alloy cast steel will be increased, but also its strength will be reduced owing to an increase of precipitated graphite. Consequently, the content of C is preferably in the range of 0.1 to 0.8%.

Si: 0.1–1.0%

In order to improve deoxidation properties and castability, it is necessary to add at least 0.1% of Si. However, if the content of Si exceeds 1.0%, the coefficient of thermal expansion will be increased. Consequently, the content of Si is preferably in the range of 0.1 to 1.0%.

Mn: 0.1–1.0%

Similarly to Si, Mn is added in order to improve deoxidation properties and castability. Accordingly, the content of Mn needs to be at least 0.1%. However, if Mn is added in an amount exceeding 1.0%, the coefficient of thermal expansion will be increased. Consequently, the content of Mn is preferably in the range of 0.1 to 1.0%.

S: 0.01–0.1%

S combines with Mg to form MgS, plays a role in inoculation by forming nuclei for spheroidal graphite, and is hence effective in suppressing a reduction in strength. However, if the content of S is less than 0.01%, no nuclei for spheroidal graphite will be formed and graphite will precipitate preferentially at grain boundaries, resulting in a markedly reduction in strength. Accordingly, the lower limit of S needs to be 0.01%. However, if S is added in a large amount exceeding 0.1%, coarse sulfides of Mn and Cr will be formed at grain boundaries, resulting in a reduction in strength and ductility. Accordingly, the content of S is preferably in the range of 0.01 to 0.1%.

Ni: Greater Than 40% and Up to 50%

Ni is the most important element for controlling the coefficient of thermal expansion in the present invention. As the content of Ni increases, the oxidation resistance of the alloy is improved. On the other hand, if the content of Ni is 40% or less, the magnetic transformation point will be reduced and, therefore, the average coefficient of thermal expansion in a temperature range of 20° C. to 500° C. will become excessively high. Consequently, if a cast steel having a Ni content of 40% or less is used in applications requiring low-thermal expansion properties up to 500° C., such as ring-shaped components for use as blade rings and seal ring retainers of gas turbines, the clearances between blades and blade rings and between seal fins and seal ring retainers will change considerably to cause a deterioration in performance.

In contrast, if the content of Ni exceeds 50%, the magnetic transformation point will exceed 500° C. and, moreover, the average coefficient of thermal expansion in a temperature range of 20° C. to the magnetic transformation point will be greatly increased. Consequently, if a cast steel having a Ni content of greater than 50% is used in applications requiring low-thermal expansion properties up to 500° C., such as ring-shaped components for use as blade rings and seal ring retainers of gas turbines, the clearances of ring-shaped components between blades and blade rings of gas turbines and between seal fins and seal ring retainers will change considerably to cause a deterioration in performance. Accordingly, the content of Ni is preferably greater than 40% and up to 50%.

Co: Not Greater Than 4% (Inclusive of 0%)

Co is an element contributing to a reduction in coefficient of thermal expansion, and Co is more effective than Ni in reducing the coefficient of thermal expansion. However, even if Co is added in an excessive amount of greater than 4%, no additional suppressive effect on the coefficient of thermal expansion can be expected. Moreover, since Co is an expensive element, the addition of a large amount of Co causes an increase in production cost. Accordingly, the content of Co is preferably not greater than 4%.

When the content of Ni is close to its upper limit specified in the present invention, the further addition of Co may increase the coefficient of thermal expansion and lead to a poor clearance. Consequently, Co may not be added (0%).

Cr: Greater Than 1.5% and Up to 4%

Cr is the element which is most effective for the improvement of high-temperature strength and oxidation resistance in the cast steel of the present invention. Especially with respect to high-temperature strength, if a cast steel having a Cr content of 1.5% or less is used in applications requiring high strength in a high-temperature region of the order of 500° C., such as ring-shaped components for use as blade rings and seal ring retainers of gas turbines, the high-temperature strength will be insufficient and, therefore, their long-term exposure to a high temperature will cause a considerable deformation. As a result, the clearances between blades and blade rings and between seal fins and seal ring retainers will change considerably to cause a deterioration in performance. Accordingly, Cr needs to be added in an amount of greater than 1.5%. On the other hand, if Cr is added in an amount exceeding 4%, the average coefficient of thermal expansion in a temperature range of 20° C. to 500° C. will be greatly increased. Consequently, if such a cast steel is used in applications requiring low-thermal expansion properties up to 500° C., such as ring-shaped components for use as blade rings and seal ring retainers of gas turbines, the clearances between blades and blade rings and between seal fins and seal ring retainers will change considerably to cause a deterioration in performance. Accordingly, the content of Cr is preferably greater than 1.5% and up to 4%.

Mg: 0.001 to 0.1%

While Mg is added for the purpose of inoculation for graphite, it has the effect of cooperating with S and Al to suppress a reduction in strength. Mg, either alone or in a form combined with S (i.e., MgS), provides nuclei for the precipitation of spheroidal graphite and is very effective in suppressing the preferential grain boundary precipitation of graphite which is responsible for a marked reduction in strength. Thus, Mg needs to be added in an amount of at least 0.001%. However, if the content of Mg exceeds 0.1%, it will form a large amount of MgO type inclusions and produce casting defects, resulting in the possibility that the castability of the alloy may be detracted from. Accordingly, the content of Mg is preferably in the range of 0.001 to 0.1%.

Al: 0.01 to 0.1%

While Al is added for the purpose of deoxidation, it has the effect of cooperating with S and Mg to suppress a reduction in strength. If the content of Al is less than 0.01%, its deoxidizing effect will be insufficient and, therefore, Mg serving to provide nuclei for spheroidal graphite will combine with O. This not only inhibits its inoculating effect on graphite, but also accelerates the grain boundary precipitation of graphite, resulting in a marked reduction in the ordinary-temperature and high-temperature strength of the alloy. However, if the content of Al exceeds 0.1%, a large amount of inclusions will undesirably be formed to produce a lot of casting defects. Accordingly, the content of Al is preferably in the range of 0.01 to 0.1%.

Although the elemental composition specified in the present invention and the content ranges of various elements have been described above, the following elements may also be added to such an extent that low-thermal expansion and high-strength properties are not detracted from.

P: ≦0.01%

Ca: ≦0.02%

Mo: ≦1.0%

W: ≦1.0%

Cu: ≦1.0%

Furthermore, the high-strength and low-thermal expansion cast steel of the present invention is preferably characterized in that its average coefficient of thermal expansion in a temperature range of 20° C. to 500° C. is not greater than $10.5\times10^{-6}$/° C., its 0.2% yield strength at 500° C. is not less than 120 MPa, and its oxidation weight gain after heating at 500° C. for 100 hours is not greater than 10 g/m$^2$. Each of these characteristics is explained below.

First of all, it is desired that, even when the high-strength and low-thermal expansion cast steel of the present invention is used in applications such as ring-shaped components for use as blade rings and seal ring retainers of gas turbines which are used in a high-temperature region of the order of 500° C., its thermal expansion properties are kept on a sufficiently low level.

For example, the aforesaid ring-shaped components for use as blade rings and seal ring retainers of gas turbines include three types: those having a service temperature of principally 200° C. or less, those which can withstand service at temperatures up to 350° C., and those which can withstand service at temperatures up to 500° C. In this case, it is required that the clearances between blades and blade rings and between seal fins and seal ring retainers should be kept almost constant in any service temperature range, and it is also desirable that the clearances between blades and blade rings and between seal fins and seal ring retainers are small. These requirements can be satisfactorily met when the average coefficient of thermal expansion in a temperature range of 20° C. to 500° C. is not greater than $10.5\times10^{-6}$/° C. Accordingly, it is specified in the present invention that its average coefficient of thermal expansion in a temperature range of 20° C. to 500° C. should preferably be not greater than $10.5\times10^{-6}$/° C.

If the low-thermal expansion properties specified in the present invention, as characterized in that the average coefficient of thermal expansion in a temperature range of 20° C. to 500° C. is preferably not greater than $10.5\times10^{-6}$/° C., are achieved, such an alloy can also be satisfactorily applied to ring-shaped components for use as blade rings and seal ring retainers of gas turbines which have a service temperature of 200° C. or 350° C.

It is also desired that, even when the high-strength and low-thermal expansion cast steel of the present invention is used in applications such as ring-shaped components for use as blade rings and seal ring retainers of gas turbines which are used in a high-temperature region of the order of 500° C., it exhibits a sufficiently high strength. For example, the aforesaid ring-shaped components for use as blade rings and seal ring retainers of gas turbines are liable to plastic deformation or creep deformation when the temperature has risen to 500° C., and their long-term exposure to a high temperature may cause a change in clearance and lead to a risk of contact. For this reason, high strength (yield strength) is required. Accordingly, it is specified in the present invention that its 0.2% yield strength at 500° C. should be not less than 120 MPa.

When the high-strength and low-thermal expansion cast steel of the present invention is used in applications such as ring-shaped components for use as blade rings and seal ring retainers of gas turbines which are used in a high-temperature region of the order of 500° C., a small oxidation weight gain is particularly desired in addition to the above-described requirements for low-thermal expansion and high-strength properties. For example, when the high-strength and low-thermal expansion cast steel of the present invention is used for the formation of ring-shaped components for use as blade rings and seal ring retainers of gas turbines, oxide scale is formed on the surface by heating and maintaining them at 500° C. It is required that such oxide scale is stable, dense, and hard to peel off. If a large amount of oxide scale is formed during heating at 500° C. and then peels off easily, the clearances between blades and blade rings and between seal fins and seal ring retainers will undesirably be increased. As a criterion for judging the adhesion of such oxide scale, the present inventors have found that, if the oxidation weight gain of an alloy after being subjected to an oxidation resistance test by heating at 500° C. for 100 hours is not greater than 10 g/m$^2$, the alloy has sufficient oxidation resistance and the problem of clearances between blades and blade rings and between seal fins and seal ring retainers can be controlled. Accordingly, the present inventors have specified that its oxidation weight gain after heating at 500° C. for 100 hours should preferably be not greater than 10 g/m$^2$.

As described above, the high-strength and low-thermal expansion cast steel of the present invention exhibits excellent low-thermal expansion properties even in a temperature region up to 500° C. and, moreover, shows an excellent strength at temperatures of the order of 500° C. Consequently, it is particularly desirable to use the high-strength and low-thermal expansion cast steel of the present invention for the formation of ring-shaped components for use as blade rings and seal ring retainers of gas turbines, because a change in clearances between blades and blade rings and between seal fins and seal ring retainers can be suppressed.

As a particularly desirable application, the high-strength and low-thermal expansion cast steel of the present invention has been described above in connection with ring-shaped components for use as blade rings and seal ring retainers of gas turbines. However, the high-strength and low-thermal expansion cast steel of the present invention may also be used in other applications requiring low-thermal expansion properties up to 500° C. and high strength in a high-temperature region of the order of 500° C., such as seal rings and bolts.

TEST EXAMPLES

Each of inventive alloy cast steels Nos. 1–8, comparative alloy cast steels Nos. 11–15, and conventional alloy cast steels Nos. 21 and 22 was melted in a weight of 10 kg. The resulting melt was poured into a sand mold measuring about 100 mm×100 mm×100 mm, and solidified by cooling in the mold. Their chemical compositions are shown in Table 1.

The prepared comparative alloy cast steel No. 11 is an alloy having a lower Ni content and no Cr addition, as compared with the inventive alloy cast steels. No. 12 has a lower Ni content as compared with the inventive alloy cast steels. No. 14 has no Cr addition as compared with the inventive alloy cast steels. No. 15 has a higher Ni content as compared with the inventive alloy cast steels. No. 13 has lower Al and Mg contents as compared with the inventive alloy cast steels. Conventional alloy cast steel No. 21 corresponds to SCS1 and No. 22 corresponds to SCPH21.

TABLE 1

| | % by mass | | | | | | | | | | |
|---|---|---|---|---|---|---|---|---|---|---|---|
| Test alloys | C | Si | Mn | S | Ni | Cr | Mo | Co | Al | Mg | Fe |
| Inventive alloys | | | | | | | | | | | |
| No. 1 | 0.61 | 0.30 | 0.18 | 0.050 | 42.3 | 2.87 | — | 3.02 | 0.048 | 0.0058 | Bal. |
| No. 2 | 0.58 | 0.43 | 0.51 | 0.061 | 44.5 | 2.51 | — | 2.49 | 0.057 | 0.0155 | Bal. |
| No. 3 | 0.45 | 0.32 | 0.30 | 0.045 | 40.5 | 3.48 | — | 3.75 | 0.045 | 0.0253 | Bal. |
| No. 4 | 0.62 | 0.75 | 0.65 | 0.048 | 48.5 | 2.86 | — | — | 0.052 | 0.0453 | Bal. |
| No. 5 | 0.55 | 0.32 | 0.48 | 0.047 | 44.9 | 1.85 | — | 1.35 | 0.062 | 0.0285 | Bal. |
| No. 6 | 0.75 | 0.38 | 0.52 | 0.058 | 43.0 | 2.75 | — | 2.25 | 0.082 | 0.0755 | Bal. |
| No. 7 | 0.59 | 0.32 | 0.47 | 0.085 | 42.6 | 2.78 | — | 2.95 | 0.049 | 0.0482 | Bal. |
| No. 8 | 0.18 | 0.31 | 0.51 | 0.054 | 43.1 | 2.69 | — | 2.87 | 0.043 | 0.0185 | Bal. |
| Comparative alloys | | | | | | | | | | | |
| No. 11 | 0.58 | 0.32 | 0.52 | 0.045 | 32.7 | — | — | 3.03 | 0.051 | 0.0405 | Bal. |
| No. 12 | 0.59 | 0.42 | 0.48 | 0.065 | 33.2 | 3.15 | — | 2.90 | 0.039 | 0.0255 | Bal. |
| No. 13 | 0.60 | 0.28 | 0.52 | 0.049 | 43.2 | — | — | 2.57 | 0.005 | 0.0005 | Bal. |
| No. 14 | 0.48 | 0.35 | 0.51 | 0.052 | 44.2 | — | — | 2.82 | 0.053 | 0.0605 | Bal. |
| No. 15 | 0.62 | 0.25 | 0.34 | 0.050 | 51.5 | 2.85 | — | 3.12 | 0.051 | 0.0155 | Bal. |
| Conventional alloys | | | | | | | | | | | |
| No. 21 | 0.12 | 0.82 | 0.31 | 0.003 | — | 12.60 | — | — | 0.052 | 0.0032 | Bal. |
| No. 22 | 0.16 | 0.48 | 0.71 | 0.004 | 0.13 | 1.21 | 0.5 | — | — | — | Bal. |

The sign "—" means that the corresponding element was not added.

Specimen materials were obtained from the prepared alloy cast steels. For the inventive alloy cast steels and the comparative alloy cast steels, each specimen material was heat-treated by holding it at 700° C. for 3 hours and then air-cooling it. For conventional alloy cast steel No. 21 corresponding to SCS1, the specimen material was quenched by holding it at 980° C. for 1 hour and then oil-cooling it, and subsequently tempered by holding it at 700° C. for 2 hours and then air-cooling it. For alloy cast steel No. 22 corresponding to SCPH21, the specimen material was quenched by holding it at 950° C. for 1 hour and then oil-cooling it, and subsequently tempered by holding it at 700° C. for 2 hours and then air-cooling it.

For the measurement of an average coefficient of thermal expansion, a specimen having a diameter of 5 mm and a length of 20 mm was measured with a differential thermal dilatometer. Thus, the average coefficients of thermal expansion in several temperature ranges extending from 20° C. to the indicated temperature were determined. A tension test at 500° C. was carried out by preparing a specimen having a parallel-portion length of 25.4 mm and a parallel-portion diameter of 6.35 mm according to an ASTM standard. An oxidation resistance test was carried out by heating a specimen having a diameter of 10 mm and a length of 15 mm in air at 350° C. or 500° C. for 100 hours, and determining a weight change per unit surface area (i.e., an oxidation weight gain) from the difference in the weight of the specimen before and after the test.

The average coefficients of thermal expansion in several temperature ranges extending from 20° C. to the indicated temperature, the results of oxidation resistance tests at 350° C. and 500° C., and the results of tension tests at 500° C. are shown in Table 2.

FIG. 2

| Test alloys | Average coefficient of thermal expansion (× $10^{-6}$/° C.) 20~200° C. | 20~350° C. | 20~500° C. | Oxidation weight gain (g/m$^2$) 350° C. × 100 hr | 500° C. × 100 hr | Tensile properties at 500° C. 0.2% yield strength (MPa) | Tensile strength (MPa) | Elongation (%) |
|---|---|---|---|---|---|---|---|---|
| Inventive alloys | | | | | | | | |
| No. 1 | 8.59 | 8.42 | 9.75 | 0.71 | 4.85 | 221 | 305 | 7.5 |
| No. 2 | 8.81 | 8.69 | 9.96 | 0.56 | 3.97 | 210 | 302 | 10.1 |
| No. 3 | 8.71 | 8.55 | 10.19 | 0.56 | 5.05 | 228 | 338 | 15.5 |
| No. 4 | 9.24 | 9.01 | 10.42 | 0.71 | 3.82 | 208 | 308 | 11.2 |
| No. 5 | 7.87 | 7.35 | 8.63 | 0.79 | 6.25 | 198 | 295 | 10.5 |
| No. 6 | 8.61 | 8.45 | 9.81 | 0.63 | 4.76 | 171 | 286 | 21.4 |
| No. 7 | 8.52 | 8.36 | 9.65 | 0.71 | 4.65 | 218 | 305 | 13.5 |
| No. 8 | 8.43 | 8.34 | 9.72 | 0.71 | 4.52 | 227 | 318 | 8.5 |
| Comparative alloys | | | | | | | | |
| No. 11 | 2.42 | 6.91 | 9.92 | 0.91 | 10.32 | 105 | 238 | 34.2 |
| No. 12 | 5.02 | 9.11 | 11.36 | 0.74 | 7.71 | 210 | 328 | 14.3 |
| No. 13 | 2.38 | 6.85 | 9.84 | 0.91 | 8.54 | 15 | 20 | 0.5 |
| No. 14 | 2.35 | 6.81 | 9.92 | 0.75 | 8.63 | 95 | 210 | 36.2 |
| No. 15 | 10.85 | 10.97 | 11.25 | 0.58 | 3.65 | 225 | 295 | 9.3 |
| Conventional alloys | | | | | | | | |
| No. 21 | 11.13 | 11.52 | 11.91 | 0 | 0 | 352 | 420 | 30.5 |
| No. 22 | 12.48 | 12.88 | 13.42 | 0.83 | 10.95 | 235 | 385 | 37.8 |

It can be seen from Table 2 that, with respect to the inventive alloy cast steels, their average coefficients of thermal expansion in a temperature range of 20° C. to 500° C. show a value of not greater than $10.5\times10^{-6}$/° C. and are hence satisfactory. However, among the inventive alloy cast steels, a slight reduction in coefficient of thermal expansion is observed in No. 1 having a lower Mn content, and a marked reduction in coefficient of thermal expansion is observed in No. 1 having a lower Co content. Thus, it can be seen that a reduction in Cr or Mn content is effective in reducing the coefficient of thermal expansion. On the other hand, among the comparative alloys, both No. 12 having a Ni content lower than the range of the present invention and No. 15 having a Ni content higher than the range of the present invention show a high coefficient of thermal expansion exceeding $10.5\times10^{-6}$/° C. Thus, it can be seen that an excessively high or low Ni content causes an increase in coefficient of thermal expansion.

Moreover, conventional alloys No. 21 (corresponding to SCS1) and No. 22 (corresponding to SCPH21) show a high value of $11.9\times10^{-6}$/° C. and $13.6\times10^{-6}$/° C., respectively.

With respect to the inventive alloy cast steels in which C and Cr having a strength-improving effect are added and Al, Mg and S are added under control in order to suppress a reduction in strength, their strengths (or 0.2% yield strengths) at 500° C. all show a value of not less than 120 MPa and are hence satisfactory. On the other hand, among the comparative alloy cast steels, No. 11, No. 13 and No. 14 showing good thermal expansion properties (i.e., a value of not greater than $10.5\times10^{-6}$/° C.) all have a low high-temperature yield strength. The cause for the low high-temperature yield strengths of No. 11 and No. 14 is the lack of Cr. Alloy cast steel No. 13 has a markedly poor strength, and the reason for this is that, in addition to the lack of Cr, Mg having an inoculating effect and Al promoting its inoculating effect are substantially absent. With respect to the inventive alloy cast steels in which Ni and Cr having the effect of improving oxidation resistance are added in sufficient amounts, their oxidation resistance at 500° C. shows a very good value of not greater than 10 g/m$^2$. On the other hand, with respect to the oxidation resistance at 500° C. of the comparative alloy cast steels, Nos. 11, 13 and 14 having insufficient contents of Ni and Cr show a high oxidation weight gain, and the weight gain of No. 11 is greater than 10 g/m$^2$. Moreover, conventional alloy cast steel No. 21 (SCS1) exhibits satisfactory oxidation resistance because it contains 12.5% of Cr. However, No. 22 (SCPH21) shows a great oxidation weight gain because the contents of elements (e.g., Cr) contributing to oxidation resistance are low.

It can be seen from the above-described results that, in the inventive alloy cast steels which are high-strength and low-thermal expansion cast steels in accordance with the present invention, their average coefficients of thermal expansion in a temperature range of 20° C. to 500° C. are lower than those of martensitic heat-resisting cast steels, and their high-temperature strength and oxidation resistance at 500° C. are satisfactory.

As described above, since the inventive alloy cast steels exhibit low thermal expansion up to 500° C. and has an excellent strength in a temperature region of the order of 500° C., they are most suitable for the formation of ring-shaped components for use as blade rings and seal ring retainers of gas turbines.

In the inventive alloy cast steels, low-thermal expansion properties can be achieved by incorporating appropriate amounts of Ni and Co, high-temperature strength at temperatures of the order of 500° C. can be enhanced by incorporating appropriate amounts of C and Cr, and moreover, a reduction in strength can be suppressed by adding appropriate amounts of such elements as S, Mg and Al. As a result, the alloys of the present invention can combine desirable properties including an excellent high-temperature strength at 500° C. and low thermal expansion in a temperature range of 20° C. to 500° C., and are hence most suitable for the formation of ring-shaped components for use as blade rings and seal ring retainers of gas turbines.

What is claimed is:

1. A high-strength and low-thermal expansion cast steel comprising, on a mass percentage basis, 0.1 to 0.8% of C, 0.1 to 1.0% of Si, 0.1 to 1.0% of Mn, 0.01 to 0.1% of S, greater than 40% and up to 50% of Ni, not greater than 4% (inclusive of 0%) of Co, greater than 1.5% and up to 4% of Cr, 0.01 to 0.1% of Al, and 0.001 to 0.1% of Mg, the remainder being substantially Fe.

2. A high-strength and low-thermal expansion cast steel as claimed in claim 1 wherein its average coefficient of thermal expansion in a temperature range of 20° C. to 500° C. is not greater than $10.5\times10^{-6}$/° C.

3. A high-strength and low-thermal expansion cast steel as claimed in claim 1 wherein its 0.2% yield strength at 500° C. is not less than 120 MPa.

4. A high-strength and low-thermal expansion cast steel as claimed in claim 1 wherein its oxidation weight gain after heating at 500° C. for 100 hours is not greater than 10 g/$m^2$.

5. A ring-shaped component for use as a blade ring of a gas turbine, the component being formed of a high-strength and low-thermal expansion cast steel as claimed in claim 1.

6. A ring-shaped component for use as a seal ring retainer of a gas turbine, the component being formed of a high-strength and low-thermal expansion cast steel as claimed in claim 1.

* * * * *